US006059489A

United States Patent [19]

Heims

[11] Patent Number: 6,059,489

[45] Date of Patent: May 9, 2000

[54] ROAD FINISHER

[75] Inventor: Dirk Heims, Bad Münder, Germany

[73] Assignee: Ingersoll-Rand Company, Woodcliff Lake, N.J.

[21] Appl. No.: 08/798,892

[22] Filed: Feb. 11, 1997

[30] Foreign Application Priority Data

Feb. 13, 1996 [DE] Germany ..... 196 05 148

[51] Int. Cl.[7] ..... E01C 19/22; E01C 9/10

[52] U.S. Cl. ..... 404/96; 404/104

[58] Field of Search ..... 404/96, 104

[56] References Cited

U.S. PATENT DOCUMENTS

| | | | |
|---|---|---|---|
| 2,848,930 | 8/1958 | Thompson . | |
| 3,130,654 | 4/1964 | Apel et al. . | |
| 3,636,831 | 1/1972 | Davin et al. | 94/45 X |
| 3,905,715 | 9/1975 | Dale | 404/84 |
| 4,861,191 | 8/1989 | Smith et al. | 404/104 |
| 5,529,434 | 6/1996 | Swisher , Jr. | 404/108 |

FOREIGN PATENT DOCUMENTS 2009427 4/1971 Germany .

OTHER PUBLICATIONS

Kapazitats–Bestimmung literature, dated juni 1983–Heft 6–bd Baumaschinendienst.

*Primary Examiner*—Tamara L. Graysay
*Assistant Examiner*—Sunil Singh
*Attorney, Agent, or Firm*—John J. Selko

[57] ABSTRACT

The invention relates to a road finisher with a chassis having a front bucket for receiving packing material and a conveying device for conveying the packing material from the bucket to a rear spreader screw arrangement which is arranged transversely with respect to the longitudinal axis of the road finisher and in front of a consolidation plank which is extendable, the consolidation plank, which is connected to the chassis via pulling arms and floats on the packing material, being divided centrally in the direction of the longitudinal axis into two plank halves, the consolidation plank being provided with a device for adjusting the inclination of two halves with respect to each other and having outer side cheeks. In order to counteract twisting of the consolidation plank and opening of the gap between the two plank halves, a clamping device, the clamping force of which can be set by a cylinder articulated on the chassis, is arranged between the chassis and the lower region of the outer side cheek.

4 Claims, 1 Drawing Sheet

ROAD FINISHER

BACKGROUND OF THE INVENTION

The invention relates to a road finisher that that can be adjusted width-wise for varying road widths, and more particularly to a road finisher that minimizes twisting and gap formation between adjustable consolidation halves, when the road finisher is adjusted to widened road widths.

Road finishers usually have a chassis having a front bucket for receiving packing material and a conveying device for conveying the packing material from the bucket to a rear spreader screw which is arranged transversely with respect to the longitudinal axis of the road finisher and in front of a consolidation plank which is extendable and additionally, or only, can have parts added to it. The consolidation plank, which is connected to the chassis via pulling arms and floats on the packing material, is divided centrally in the direction of the longitudinal axis of the chassis and is provided with a device for adjusting the shoulder-centre line straight finish. The latter device serves to provide the packed material with a corresponding shoulder-centre line straight finish, i.e. a gradient towards the sides of the road.

Since the consolidation plank can only be extended to approximately twice the width of the road finisher, for greater packing widths parts are added manually to the consolidation plank accordingly. However, on the one hand this leads, under a corresponding loading of the consolidation plank, to a twisting in the region of the consolidation plank which has been extended and has attached parts added to it and, on the other hand, this can have the effect, in the front lower region where the consolidation plank is divided, that the gap between the two plank halves opens when setting the inclination of the two plank halves with respect to each other, so that packing material can penetrate into this gap, which then leads to the gap widening yet further. Both these effects lead to packing errors.

The object of the invention is to provide a road finisher in accordance, which counteracts twisting of the consolidation plank and opening of the gap between the two plank halves.

SUMMARY OF THE INVENTION

In one aspect of the present invention, this is accomplished by providing a road finisher with a chassis; a front bucket on the chassis, for receiving packing material; a conveying device on the chassis, for conveying the packing material from the bucket to a rear spreader; a screw arrangement on the chassis positioned transversely with respect to a longitudinal axis of the road finisher and in front of a consolidation plank, the consolidation plank being extendable width-wise; the consolidation plank being connected to the chassis via pulling arms; the consolidation plank, floatable on the packing material, being divided centrally in the direction of the longitudinal axis into two plank halves; means connecting said two plank halves, for adjusting the inclination of said two halves with respect to each other; a pair of outer side cheeks, one side cheek positioned outboard of each consolidation plank halve, each said side cheek connected to said chassis; and a pair of clamping devices, the clamping force of each device which can be set by means of a cylinder articulated on the chassis, each clamping device being positioned between said chassis and a lower region of each adjacent outer side cheek, whereby twisting of said consolidation means and widening of a gap between consolidation plank halves is minimized.

The foregoing and other aspects will become apparent from the following detailed description of the invention when considered in conjunction with the accompanying drawing figures.

BRIEF DESCRIPTION OF THE DRAWING FIGURES

FIG. 1 diagrammatically shows a top view of a road finisher, with parts removed, the road finisher being substantially similar on each side of its longitudinal axis; and FIG. 2 shows an excerpt of a view of the side region of a consolidation plank of the road finisher of FIG. 1.

DETAILED DESCRIPTION

Figure 2:
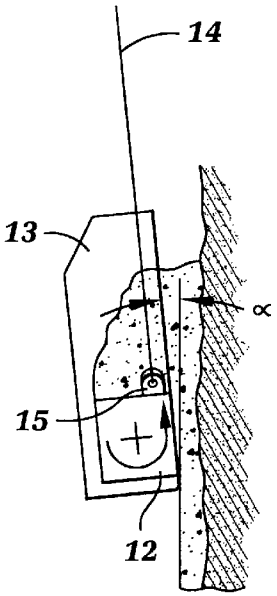
Figure 1:
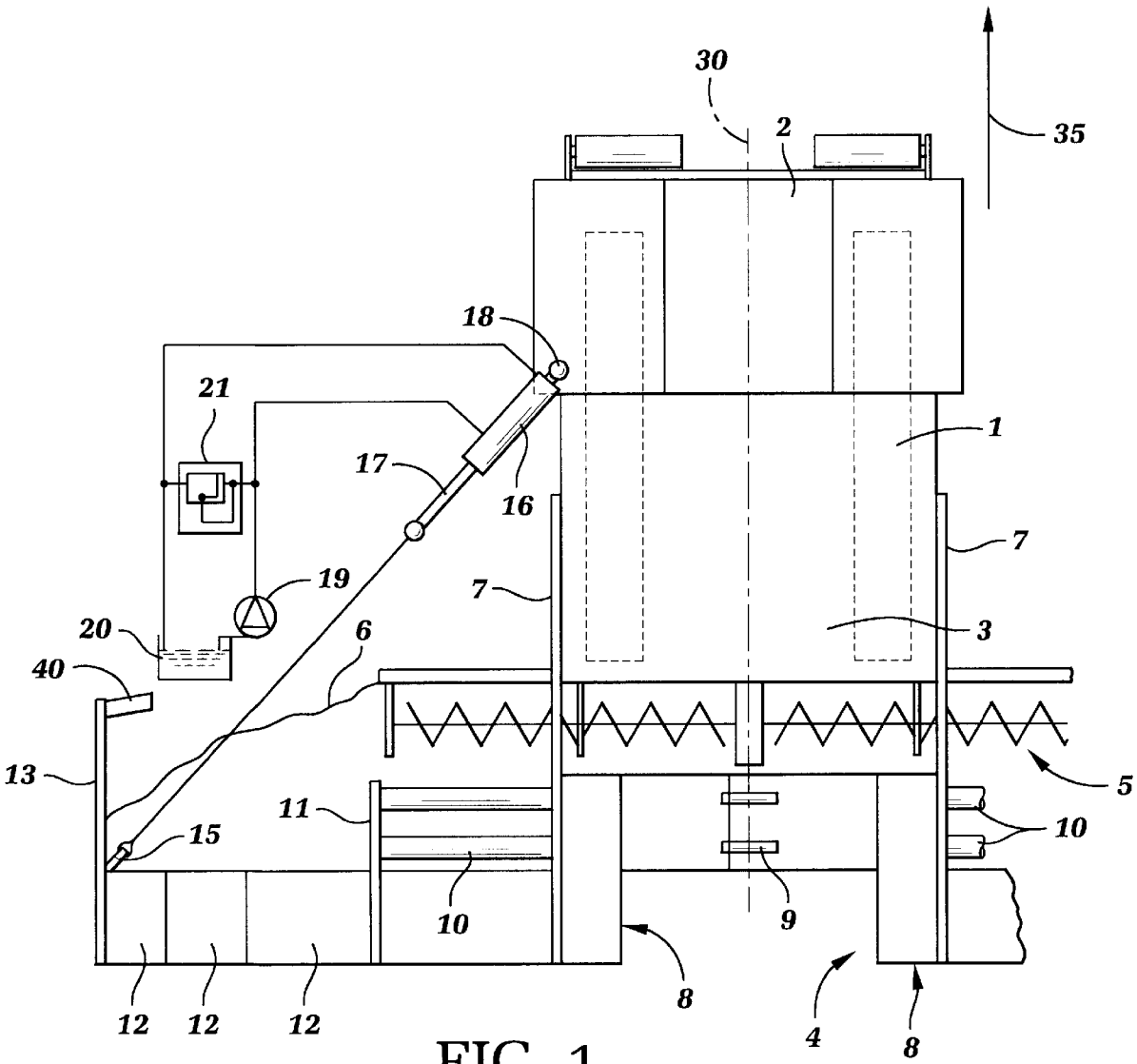

The road finisher illustrated comprises a chassis 1, which at the front has a bucket 2 for receiving packing material, which is tipped into the bucket 2, for example from a lorry. The packing material is conveyed from the bucket 2 by means of a conveying device 3 (plate conveyer or the like) to in front of a rear consolidation plank 4. A spreader screw arrangement 5 for spreading the packing material 6 conveyed in front of the consolidation plank 4 is arranged in front of the consolidation plank 4 in the direction of travel.

The consolidation plank 4 is fastened on the chassis 1 via pulling arms 7, so that it is pulled along and floats on the packing material 6, cf. also FIG. 2.

The consolidation plank 4 is divided centrally in the direction of travel and therefore comprises two plank halves 8, the inclination of which with respect to one another and transversely with respect to the direction of 35 travel of the road finisher is adjustable by means of a device 9 (control cylinder or manually actuable spindles) according to the desired roof profile of the road.

The spreader screw arrangement 5, is divided centrally in the direction of longitudinal axis 30 into two plank halves 8.

Each of the plank halves 8 is extendable, to which end in each case one plank guide 10 (telescopic guide rods) is provided, which rods are fastened to an outer side cheek 11 of the respective plank half 8. The spreader screw arrangement 5 can be widened approximately to the width of the extended plank halves 8.

In addition, plank parts 12 can be added to the plank halves 8 when the packing width demands, an outer, forwardly extended side cheek 13 being arranged right at the outside, which cheek prevents packing material 6 from escaping from the packing area.

In each case one clamping device is arranged between the chassis 1 and the lower region of the outer side cheek 13. This clamping device comprises a cable 14, which is fastened to a bracket 15 which is welded or bolted onto the lower region of the outer side cheek 13, specifically to the inside thereof. The other end of the cable 14 is fastened on that end of a piston rod 17 which projects out of a cylinder 16. The cylinder 16 is articulated on the chassis 1 via a ball-and-socket joint 18.

The cylinder 16 is situated in a circuit comprising a hydraulic pump 19 and a reservoir 20 for hydraulic liquid, so that the piston (not shown) of the cylinder 16 is acted on accordingly. The hydraulic pump 19 provides a constant pressure of, for example, 100 bar. An adjustable valve 21 is connected in parallel with the cylinder 16, by means of which valve the clamping force of the cylinder 16 and thus of the clamping device thus formed can be adjusted.

The cylinder 16 is sufficiently long for it to be possible to compensate changes in length, which are caused by different extension positions and/or added-on parts 12 of the consolidation plank 4, between the bracket 15 and the cylinder 16 by changing the length of the piston rod 17 which projects out of the cylinder 16 while the length of the cable 14 remains the same.

For extreme widths, a different length of cable can be selected for a certain width range.

The valve 21 and thus the force exerted on the outer side cheek 13 can be set to the current plank width. In addition, it is possible and advantageous for the valve 21 to be adjustable in accordance with the amount of packing material situated in front of the consolidation plank 4 and detected by means of sensors 40.

The fact that the cable 14 engages on the lower region of the outer side cheek 13 results in a lever arm which, on the one hand, counteracts a widening of the gap between the two plank halves 8 in the region of the device for adjusting the roof profile of the road and, on the other hand, counteracts twisting of the plank halves 8 which have been extended and have had parts added to them.

What is claimed:

1. A road finisher with a chassis; a front bucket on the chassis, for receiving packing material; a conveying device on the chassis, for conveying the packing material from the bucket to a rear spreader; a screw arrangement on the chassis positioned transversely with respect to a longitudinal axis of the road finisher and in front of a consolidation plank, the consolidation plank being extendable width-wise; the consolidation plank being connected to the chassis via pulling arms; the consolidation plank, floatable on the packing material, being divided centrally in the direction of the longitudinal axis into two plank halves; means connecting said two plank halves, for adjusting the inclination of said two halves with respect to each other; the improvement comprising:

(a) a pair of outer side cheeks, one side cheek positioned outboard of each consolidation plank halve, each said side cheek connected to said chassis;

(b) a pair of clamping devices, the clamping force of each device which can be set by means of a cylinder articulated on the chassis, each cylinder being positioned on the chassis toward the front thereof, in the direction of travel in relation to the consolidation plank halves, each clamping device including a flexible cable means extending between the cylinder to a lower region of each adjacent outer side cheek, the cable means supporting the consolidation plank in tension, as the road finisher moves forward, whereby twisting of said consolidation plank and widening of a gap between consolidation plank halves is minimized.

2. The road finisher according to claim 1, characterized in that a change in length of the clamping device, brought about by the changes in the width of the consolidation plank can be compensated by means of said cylinder.

3. The road finisher according to claim 2, characterized in that said cylinder is arranged in a pump circuit including an adjustable valve connected in parallel with said cylinder.

4. The road finisher according to claim 3, characterized in that said valve can be adjusted in accordance with the amount of packing material situated in front of said consolidation plank and detected by means of sensors.

* * * * *